US012421846B2

(12) United States Patent
Moe et al.

(10) Patent No.: US 12,421,846 B2
(45) Date of Patent: Sep. 23, 2025

(54) SYSTEM AND METHOD FOR BARRIER TESTING

(71) Applicant: FMC Kongsberg Subsea AS, Kongsberg (NO)

(72) Inventors: Sigurd Moe, Kongsberg (NO); Piotr Siebyla, Kongsberg (NO)

(73) Assignee: TechnipFMC Norge AS, Kongsberg (NO)

( * ) Notice: Subject to any disclaimer, the term of this patent is extended or adjusted under 35 U.S.C. 154(b) by 0 days.

(21) Appl. No.: 18/861,021

(22) PCT Filed: Apr. 18, 2023

(86) PCT No.: PCT/EP2023/059986
§ 371 (c)(1),
(2) Date: Oct. 28, 2024

(87) PCT Pub. No.: WO2023/208647
PCT Pub. Date: Nov. 2, 2023

(65) Prior Publication Data

US 2025/0109683 A1 Apr. 3, 2025

(30) Foreign Application Priority Data

Apr. 28, 2022 (NO) ..... 20220478

(51) Int. Cl.
*E21B 33/035* (2006.01)
*E21B 47/117* (2012.01)

(52) U.S. Cl.
CPC ..... *E21B 47/117* (2020.05); *E21B 33/035* (2013.01)

(58) Field of Classification Search
CPC ..... E21B 33/035; E21B 47/117
See application file for complete search history.

(56) References Cited

U.S. PATENT DOCUMENTS 9,702,212 B2 * 7/2017 Breda ..... E21B 43/129
9,702,249 B2 * 7/2017 Gordon ..... E21B 49/088
(Continued)

FOREIGN PATENT DOCUMENTS

WO 0238912 A1 5/2002
WO WO-2006062512 A1 * 6/2006 ..... E21B 47/1025
(Continued)

OTHER PUBLICATIONS

International Search Report and Written Opinion for Application No. PCT/EP2023/059986, dated Aug. 3, 2023.

*Primary Examiner* — Matthew R Buck
(74) *Attorney, Agent, or Firm* — Kevin E. West; Advent, LLP

(57) ABSTRACT

A system and methods for barrier testing of a X-mas tree production system. The X-mas tree comprises a fluid line between a set of two barrier valves, one of the barrier valves of the set of two barrier valves being an upstream barrier valve closer to a reservoir and the other barrier valve being a downstream barrier valve closer to an environment. The system provides fluid at different test pressures to the fluid line between the downstream barrier valve and the upstream barrier valve. The system comprises a first fluid connection line from a fluid source to a pressure increasing unit; a second fluid connection line from the pressure increasing unit to a first connection point on the fluid; and a third fluid connection line from a fluid receiving unit to a second connection point on the second fluid connection line.

15 Claims, 1 Drawing Sheet

(56) References Cited

U.S. PATENT DOCUMENTS

| | | | | |
|---|---|---|---|---|
| 11,306,557 | B2 | 4/2022 | Murphy et al. | |
| 2020/0018134 | A1 | 1/2020 | Løvoll et al. | |
| 2024/0318745 | A1* | 9/2024 | Stokke ..... | G01M 3/2876 |

FOREIGN PATENT DOCUMENTS

| | | | |
|---|---|---|---|
| WO | 2012148288 | A1 | 11/2012 |
| WO | 2017118727 | A1 | 7/2017 |

* cited by examiner

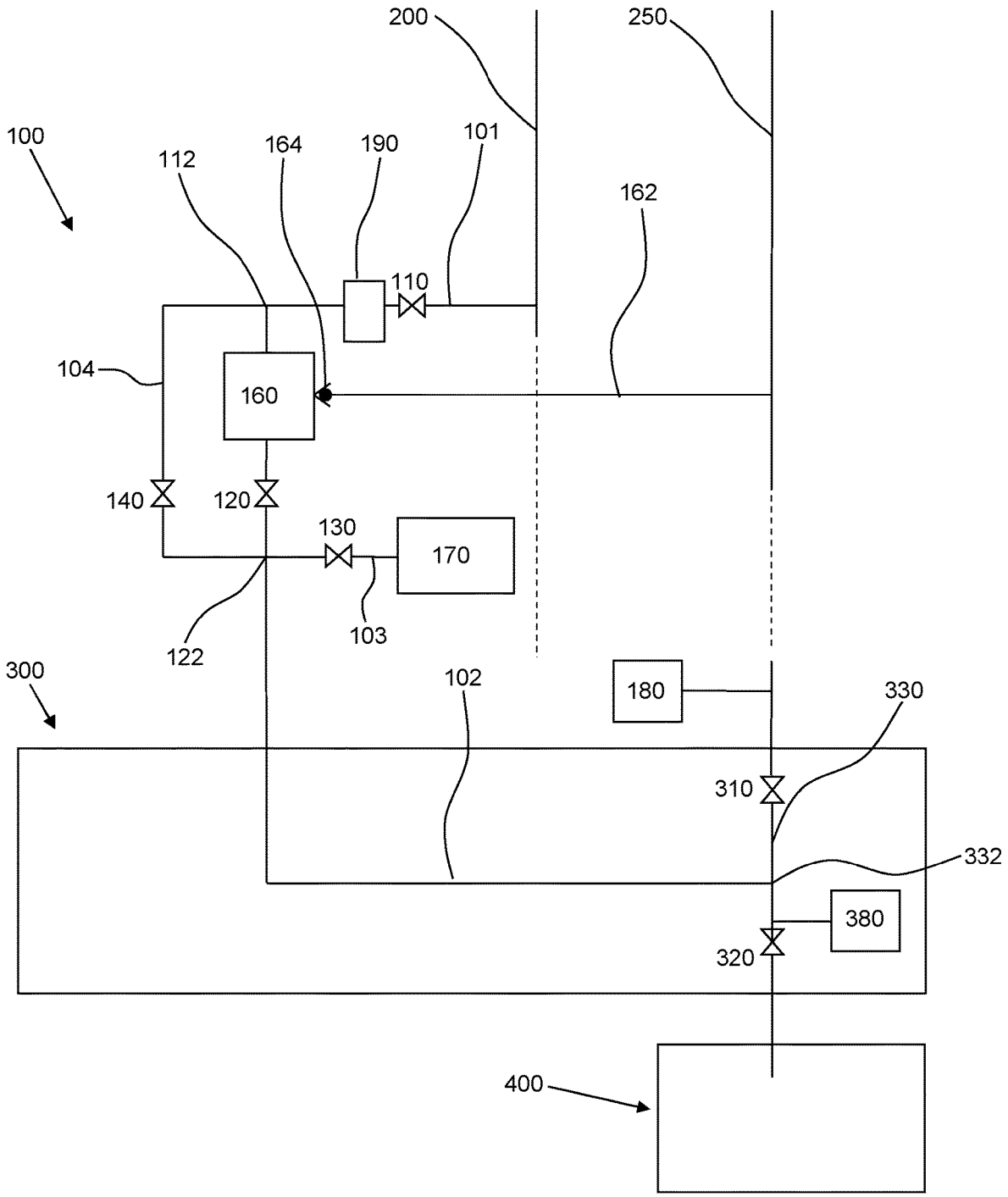
200
250
100
112
164
190
101
162
110
104
160
140
120
130
170
103
122
300
102
180
330
310
332
380
320
400

SYSTEM AND METHOD FOR BARRIER TESTING

CROSS REFERENCE TO RELATED APPLICATIONS

The present application is a National Stage Entry of International Application No. WO 2023/208647, filed on Apr. 18, 2023, and titled "SYSTEM AND METHOD FOR BARRIER TESTING", which claims priority to Norwegian application No. NO 202220478, filed on Apr. 28, 2022, and titled "SYSTEM AND METHOD FOR BARRIER TESTING". International Application WO 2023/208647 and Norwegian application No, NO202220478 are herein incorporated by reference in their entireties.

TECHNICAL FIELD

The present disclosure relates to a system and a method for barrier testing. More particularly, the present disclosure relates to a system and method for barrier testing barrier valves of a X-mas tree production system in the oil and gas industry.

BACKGROUND

Barriers and valves in the oil and gas industry are required to be tested regularly to ensure barrier integrity. Such testing and frequency of testing is regulated and can be as often as once a month. The current practice for barrier testing valves in a X-mas tree production system is to use a separate service line in the umbilical between topside and subsea to set up the required pressure for the barrier testing. The pressure in the separate service line is controlled from the topside and is set higher or lower than the well shut in pressure. This creates a differential pressure that would decay if the valve barrier is not intact. This is detected by pressure transmitters of the subsea production system during the testing.

Commonly, the service line is filled with hydrate inhibitor such as mono ethylene glycol (MEG). In long distance gas fields, MEG is injected continuously as a hydrate inhibitor. Current practice is to implement two MEG filled lines, one for the hydrate inhibition function and one to act as the separate service line, the latter where the pressure is manipulated for pressure testing. To have two MEG lines adds cost, but is required today since the pressure of the main hydrate inhibitor line for continuous injection cannot be manipulated without all the wells connected to the main hydrate inhibitor line operationally having to be shut in.

A problem is that the barrier testing takes place subsea, possibly at several thousand meters dept. A further technical problem is that any part of a solution must function with new and existing subsea production systems, and must function without a possibility to fail, fulfil technical and legal requirements, and is easy to use. It is desirable that any solution is simple, not expensive to produce, and is reliable. It is further a technical problem to avoid cumbersome arrangements that are expensive to manufacture or assemble. It is desirable that any part of the solution, or at least some parts of the solution, can be retrieved or interchanged.

SUMMARY

It is an object of the present disclosure to provide a system and a method for barrier testing of a X-mas tree production system. This object can be achieved by the features as defined by the independent claims. Further enhancements are characterized by the dependent claims. The system and the method for barrier testing may be used for any other subsea valve configuration that needs barrier testing.

The system and method eliminate the need for the service line for individual well barrier testing, while for example continuous MEG injection can be maintained. The claimed set-up of a pressure increasing unit, fluid lines, and valves core of the system is a pressure intensifier (for example a subsea pump) and valve set-up where fluid may be tapped off a service line, for example the main MEG line for hydrate inhibition, and vented to a line or a fluid receiving unit (for example a container with lower pressure). The claimed system and method enables the manipulation of pressure for barrier testing, i.e. to set up the differential pressure required for barrier testing, in the same way as if pressure was from the topside via the service line for individual well barrier testing.

Embodiments may also support solving subsea production operational challenges such as reduction of well pressure for well startup, discharge of MEG into flowline, vent of annulus, pressure release to melt hydrate plugs, to set up a bullheading pressure higher than pipeline pressure, etc. Embodiments may eliminate umbilical annulus bleed lines, common per well or per template for production wells and water injection wells.

According to one embodiment, a system for barrier testing of a X-mas tree production system is disclosed. The X-mas tree is subsea and comprises a fluid line between a set of two barrier valves, one of the barrier valves of the set of two barrier valves being an upstream barrier valve closer to a reservoir and the other barrier valve being a downstream barrier valve closer to an environment, and pressure monitoring devices in the fluid line and downstream of the downstream barrier valve. The system provides fluid at different test pressures to the fluid line between the downstream barrier valve and the upstream barrier valve. The system comprises a first fluid connection line from a fluid source to a pressure increasing unit, with a first valve positioned in the first fluid connection line. The system comprises a second fluid connection line from the pressure increasing unit to a first connection point on the fluid line between the downstream barrier valve and the upstream barrier valve, with a second valve positioned in the second fluid connection line. The system comprises a third fluid connection line from a fluid receiving unit to a second connection point on the second fluid connection line, the second connection point being between the second valve and the first connection point, with a third valve positioned in the third fluid connection line, such that fluid at the different test pressures may be provided to the fluid line between the barrier valves for testing of the barrier.

According to one embodiment, the system may comprise a fourth fluid connection line from a third connection point to the second connection point, the third connection point being on the first connection line and between the pressure increasing unit and the first valve, with a fourth valve positioned in the fourth fluid connection line.

According to one embodiment, the pressure increasing unit may comprise a pump for pumping fluid in only one direction from the pump towards the second valve.

According to one embodiment, the system may further comprise a fluid connection drain line from the pressure increasing unit to a production flow line, with a check valve positioned in the fluid connection drain line only allowing fluid to flow from the pressure increasing device to the production flow line.

According to one embodiment, the system may further comprising a filter positioned in the first fluid connection line. The system may be arranged on a subsea X-mas tree, or on or in a manifold, or on a skid. The system may be arranged separately from, and fluidly connected to, the X-mas tree production system.

According to one embodiment, the pressure increasing unit may be a battery driven pump, or a hydraulically driven pump, and the pressure increasing unit is retrievable. According to one embodiment, the first fluid source may be a service line.

According to at least one embodiment, a method for barrier testing of a X-mas tree production system according to any one of the preceding embodiments, for testing with a test pressure above a pressure of the reservoir, is disclosed. The method comprises open the first valve, open the second valve, close the third valve, close the fourth valve, and use the pressure increasing unit to increase the fluid test pressure in the fluid line to the desired barrier test pressure value, using fluid from the first source.

According to at least one embodiment, a method for barrier testing of a X-mas tree production system according to any one of the preceding embodiments, for testing with a test pressure below a pressure of the reservoir, is disclosed. The method comprises close the first valve, open the third valve, and use the fluid receiving unit to reduce the fluid pressure in the fluid line to the desired barrier test pressure value. An alternatively to this method is to close the second valve, close the fourth valve, open the third valve, and use the fluid receiving unit to reduce the fluid pressure in the fluid line to the desired barrier test pressure value.

According to at least one embodiment, a method for barrier testing a master valve, the master valve being the upstream barrier valve, is disclosed. The method comprises closing the master valve, open the first valve, open the second valve, close the third valve, close the fourth valve, close the downstream barrier valve, and use the pressure increasing unit to increase the fluid test pressure to the desired barrier test pressure value for the master valve, keep the pressure for a predetermined time period and check the pressure monitoring devices in the fluid line to detect pressure changes. This method for barrier testing a master valve may be a method for testing with a test pressure above a pressure of the reservoir.

According to at least one embodiment, a method for barrier testing a wing valve, the wing valve being the downstream barrier valve, is disclosed. The method comprises closing the wing valve, open the first valve, open the second valve, close the third valve, close the fourth valve, close the upstream barrier valve, and use the pressure increasing unit to increase the fluid test pressure to the desired barrier test pressure value for the wing valve, keep the pressure for a predetermined time period and check the pressure monitoring devices in the fluid line to detect pressure changes. This method for barrier testing a wing valve may be a method for testing with a test pressure above a pressure of the reservoir.

According to at least one embodiment, the method may further comprise to initially flush the system by, open the first valve, close the second valve, close the third valve, open the fourth valve, and vent via the X-mas tree or via an annulus of the reservoir.

According to at least one embodiment, the pressure increasing unit may use fluid from the first fluid source, the first fluid source being a service line.

At least one of the above embodiments provides a system and method for testing if barrier valves are intact, and one or more solutions to the problems and disadvantages with the background art. Other technical advantages of the present disclosure will be readily apparent to one skilled in the art from the following description and claims. Various embodiments of the present application obtain only a subset of the advantages set forth. No one advantage is critical to the embodiments. Any claimed embodiment may be technically combined with any other claimed embodiment or embodiments.

BRIEF DESCRIPTION OF THE DRAWING

The accompanying drawing illustrate presently exemplary embodiments of the disclosure and serve to explain, by way of example, the principles of the disclosure.

FIG. 1 is a diagrammatic illustration of a system for barrier testing according to an exemplary embodiment of the disclosure.

DETAILED DESCRIPTION

FIG. 1 is a diagrammatic illustration of a system for barrier testing of a X-mas tree production system (300). The X-mas tree production system (300) may be connected to a reservoir (400) in the usual manner, for example to a well (400) or to the tubing hanger (400). A production line (250) may extend from the X-mas tree production system (300) to the topside. A fluid source (200), for example a service line (200), may also extend from the X-mas tree production system (300) to the topside. The system in FIG. 1 may be a subsea hydrocarbon production system, for example for oil or gas.

The system is for barrier testing of a X-mas tree production system (300), where the X-mas tree is subsea and comprises a fluid line (330). The fluid line (330) is between a set of two barrier valves (310,320). One of the barrier valves of the set of two barrier valves being an upstream barrier valve (320) closer to a reservoir (400) and the other barrier valve being a downstream barrier valve (310) closer to an environment. The upstream barrier valve (320) may for example be a master valve (320), and the downstream barrier valve (310) may be for example a wing valve (310). The X-mas tree also comprises pressure monitoring devices (180, 380) in the fluid line (330) and downstream of the downstream barrier valve (310). One or more of the pressure monitoring devices (180) is in the fluid line (330) and one or more of the pressure monitoring devices (380) is downstream of the downstream barrier valve (310). In this way different pressures may be monitored within the X-mas tree and the X-mas tree production system (300). The system provides fluid at different test pressures to the fluid line (330) between the downstream barrier valve (310) and the upstream barrier valve (320). Hereby at least the downstream barrier valve (310) and the upstream barrier valve (320) can be barrier tested. Other valves, sealing, or fluid lines within the X-mas tree production system may also be barrier tested.

The system comprises a first fluid connection line (101) from a fluid source (200) to a pressure increasing unit (160). The first fluid connection line (101) may allow fluid to be channeled between the fluid source (200) and the pressure increasing unit (160). The system also comprises a first valve (110) positioned in the first fluid connection line (101). The first valve (110) may be opened or closed and control fluid channeled in the first fluid connection line (101) between the fluid source (200) and the pressure increasing unit (160). The fluid source (200) may be a service line, for example for MEG, from the topside to the X-mas tree production system (300).

The system comprises a second fluid connection line (102) from the pressure increasing unit (160) to a first connection point (332). The first connection point (332) is on the fluid line (330) between the downstream barrier valve (310) and the upstream barrier valve (320). The second fluid connection line (102) may allow fluid to be channeled between the pressure increasing unit (160) and the first connection point (332). The system also comprises a second valve (120) positioned in the second fluid connection line (102). The second valve (120) may be opened or closed and control fluid channeled in the second fluid connection line (102) between the pressure increasing unit (160) and the first connection point (332).

The system comprises a third fluid connection line (103) from a fluid receiving unit (170) to a second connection point (122). The second connection point (122) is on the second fluid connection line (102). The second connection point (122) is positioned between the second valve (120) and the first connection point (332). The third fluid connection line (103) may allow fluid to be channeled between the fluid receiving unit (170) and the second connection point (122). The system comprises a third valve (130) positioned in the third fluid connection line (103). The third valve (130) may be opened or closed and control fluid channeled in the third fluid connection line (103) between the fluid receiving unit (170) and the second connection point (122). The fluid receiving unit (170) may, for example, be an accumulator. The fluid receiving unit (170) may be able to receive pressurised fluid and subsequently, in a controlled manner from the topside, return the received pressurised fluid via the third fluid connection line (103).

The system is arranged such that fluid at the different test pressures may be provided to the fluid line (330) between the barrier valves (310, 320) for testing of the barrier valves (310, 320). By arranging the fluid connection lines, the valves, the pressure increasing unit (160), and the fluid receiving unit (170) as described, the two barrier valves may be tested if they are intact. Instead of having to use a dedicated service line for testing, an existing fluid source may be used. With the system, test pressures may be set different, higher or lower, than the well, the reservoir (400), the shut-in pressure. This creates a differential pressure that would decay if the barrier valves are not intact. The decay may be monitored by the pressure monitoring devices (180, 380) of the system during the testing. This is also further described below.

According to one embodiment, and as illustrated in FIG. 1, the system may further comprise a fourth fluid connection line (104) from a third connection point (112) to the second connection point (122). The fourth fluid connection line (104) may allow fluid to be channeled between the third connection point (112) and the second connection point (122). The third connection point (112) is on the first connection line (101) and is between the pressure increasing unit (160) and the first valve (110). The system may comprise a fourth valve (140) positioned in the fourth fluid connection line (104). The fourth valve (140) may be opened or closed and control fluid channeled in the fourth fluid connection line (104) between the third connection point (112) and the second connection point (122). The arrangement may be such that the fourth valve (140) is in parallel to a series of the pressure increasing unit (160) and the second valve (120). The fourth fluid connection line (104) and the fourth valve (140) may be used for venting, flushing, before barrier testing, but in other tests, for example involving increasing or reducing pressure, the fourth fluid connection line (104) and the fourth valve (140) may not be necessary.

According to one embodiment, the pressure increasing unit (160) may comprise a pump (160) for pumping fluid in only one direction from the pump towards the second valve (120). This allows the system to be a functional and robust system with a low possibility of malfunction. The pressure increasing unit (160) may be retrievable. The pressure increasing device (160) may be a pump driven by electricity, or driven by the fluid from the fluid source (200), for example a service flow line, or be a pressure intensifier creating a higher pressure by different diameter pistons at inlet and outlet sides.

The pressure increasing unit (160) and/or the associated valves may be part of a separately retrievable unit, or may be part of a remotely operated vehicle, ROV, skid systems with local hydraulic power generation. For an electrically powered pressure increasing unit (160), as the testing and hence pressure increasing, pumping, is required only intermittently, electric power to the pressure increasing unit (160) may be stored in batteries subsea, providing a solution that allows an all-electric subsea systems and eliminates the need for a subsea infrastructure designed for a peak power demand.

According to one embodiment, the system may further comprise a fluid connection drain line (162) from the pressure increasing unit (160) to a production flow line (250), with a check valve (164) positioned in the fluid connection drain line (162) only allowing fluid to flow from the pressure increasing device (160) to the production flow line (250). The fluid connection drain line (162) allows for the system to be drained by the pressure increasing device (160) expelling fluid out from the system, for example to the production flow line (250). The check valve (164) may be controllable, for example from the topside. The check valve (164) may be controlled to closed or opened. The fluid connection drain line (162) and the check valve (164) may be arranged such that operating the pressure increasing unit (160) does not pump or direct fluid through the fluid connection drain line (162) and the check valve (164).

According to one embodiment, the system may further comprise a filter (190) positioned in the first fluid connection line (101). The filter (190) may be positioned in the first fluid connection line (101) between the first valve (110) and the third connection point (112). The filter (190) may allow the fluid to pass but stop any other contaminations. The filter (190) may be retrievable.

According to one embodiment, the system may be arranged on a subsea X-mas tree, or on or in a manifold, or on a separate skid. The system may be added to an already existing X-mas tree production system (300), or the system may be incorporated to a new X-mas tree production system (300). According to one embodiment, one or more elements of the system may be arranged on a subsea X-mas tree, or on or in a manifold, or on a skid. The system may be a separate system added to a X-mas tree production system (300).

According to one embodiment, the system may be arranged separately from, and fluidly connected to, the X-mas tree production system (300). The system may be separately arranged on a skid and placed next to the X-mas tree production system (300). The system may be only fluidly connected to the X-mas tree production system (300). The fluid connection may be done with the second fluid connection line (102) from the pressure increasing unit (160)

to the first connection point (332) on the fluid line (330) between the downstream barrier valve (310) and the upstream barrier valve (320). The system may be connected to one or more X-mas trees or other valves systems where regular barrier testing is required or operationally beneficial.

According to one embodiment, the pressure increasing unit (160) may be a battery driven pump, or a hydraulically driven pump, or a pressure intensifier. The hydraulically driven pump may be driven from, for example, hydrate inhibitor, hydraulic fluid, or injection water. The pressure increasing unit (160) may be retrievable. The pressure increasing unit (160) may be removably connected to the system, such that it can be retrieved, for example by a remotely operated vehicle (ROV). This allows the pressure increasing unit (160) to be exchanged or serviced.

According to one embodiment of the system described herein may be configured to be retrievable. The four fluid connection lines (101, 102, 103, 104), the pressure increasing unit (160), the fluid receiving unit (170), the filter (190), the first valve (110), the second valve (120), the third valve (130), and the fourth valve (140) may all be retrievable, independently or together. The pressure increasing unit (160) and the filter (190) may be each separately and independently retrievable from the rest. This may require further valves before and after the pressure increasing unit (160) and the filter (190).

According to one embodiment, the first fluid source (200) may be a service line, such as a service line for fluid from the topside to the X-mas tree production system (300). The first fluid source (200) may be a service line to the X-mas tree, such as a service line providing mono ethylene glycol (MEG), or methanol, ethanol, scale inhibitor, or water. This may also be the fluid used for testing the barriers. This allows an existing service line to be used for barrier testing instead of requiring a separate fluid line for barrier testing.

According to one embodiment, the system for barrier testing of a X-mas tree production system (300) does not comprise, or require, any further element or elements. The system may need no further valves, fluid connection lines, pressure increasing units, fluid receiving unit, or any other element, for realizing the system for barrier testing of a X-mas tree production system. According to one embodiment of the system described herein, the four fluid connection lines (101, 102, 103, 104) connect the pressure increasing unit (160), the fluid receiving unit (170), the filter (190), the first valve (110), the second valve (120), the third valve (130), and the fourth valve (140) directly to each other as described herein, excluding other elements. According to one embodiment, there are no further fluid connection lines between the pressure increasing unit (160), the fluid receiving unit (170), the first valve (110), the second valve (120), the third valve (130), and the fourth valve (140).

According to one embodiment, all the valves (110, 120, 130, 140) are remotely controllable so that the valves may be opened or closed according to instructions from the topside. According to one embodiment, the pressure increasing device (160) and/or the fluid receiving unit (170) are remotely controllable so that they may be operated according to instructions from the topside. The pressure monitoring devices (180, 380) may be remotely readable, such that their monitored pressure may be taken at the topside. The valves (110, 120, 130, 140), the pressure increasing device (160) and/or the fluid receiving unit (170) may in addition be remotely controllable by using a ROV. The pressure monitoring devices (180, 380) may in addition be remotely readable by using a ROV. The valves required for barrier testing may be remotely controllable with local back-up, for example local ROV back-up. The valves required for system replacement may be controlled locally by a ROV during replacement.

A method for barrier testing with the system according to any one of the embodiments described herein, or any combination of embodiments described herein, is disclosed. The method sets out opened or closed positions of the valves (110, 120, 130, 140) and how the pressure increasing unit (160) and the fluid receiving unit (170) are operated to test if the barrier valves are intact or leak. This allows the system to provide fluid at different test pressures to the fluid line (330) between the downstream barrier valve (310) and the upstream barrier valve (320).

Described is a method for barrier testing with the system according to any one of the embodiments described herein, or any combination of embodiments described herein, for testing with a test pressure above a pressure of the reservoir (400). That is for testing the barrier valves with a higher pressure than the well shut in pressure, for example at a higher pressure than the pressure in the production line (250). The method comprises to open the first valve (110), open the second valve (120), close the third valve (130), close the fourth valve (140), and use the pressure increasing unit (160) to increase the fluid test pressure in the fluid line (330) to the desired barrier test pressure value, using fluid from the first source (200). In this way the test pressure is increased to the selected test pressure in the fluid line (330). The test pressure is then held at this level and since the downstream barrier valve (310) and the upstream barrier valve (320) are closed, a change, for example a decrease, in the pressure level detected by the pressure monitoring device (380) indicates that the barrier valves are not intact. In the embodiment where the fourth valve (140) and the fourth fluid connection line (104) are not present, then the method is the same since the fluid can not pass in parallel to the series of the pressure increasing unit (160) and the second valve (120).

Described is a method for barrier testing with the system according to any one of the embodiments described herein, or any combination of embodiments described herein, for testing with a test pressure below a pressure of the reservoir (400). That is for testing the barrier valves with a lower pressure than the well shut in pressure, for example at a lower pressure than the pressure in the production line (250). The method comprises to close the first valve (110), open the third valve (130), and use the fluid receiving unit (170) to reduce the fluid pressure in the fluid line (330) to the desired barrier test pressure value; alternatively close the second valve (120), close the fourth valve (140), open the third valve (130), and use the fluid receiving unit (170) to reduce the fluid pressure in the fluid line (330) to the desired barrier test pressure value. Fluid within the fluid line (330) is received by the fluid receiving unit (170) and such transfer of fluid reduces the pressure within the X-mas tree production system (300). Both alterative valve positions achieve this. In this way the test pressure is reduced to the selected test pressure in the fluid line (330). The test pressure is then held at this level and since the downstream barrier valve (310) and the upstream barrier valve (320) are closed, a change, for example an increase, in the pressure level detected by the pressure monitoring device (380) indicates that the barrier valve are not intact.

According to one embodiment, the method may include testing a master valve (320). Described is a method according to any one of the embodiments described herein, or any combination of embodiments described herein, for barrier testing a master valve (320). In FIG. 1 the master valve is the upstream barrier valve (320). The method comprises close the master valve (320), open the first valve (110), open the second valve (120), close the third valve (130), close the fourth valve (140), close the downstream barrier valve (310), and use the pressure increasing unit (160) to increase the fluid test pressure to the desired barrier test pressure value for the master valve (320). Then keep the pressure for a predetermined time period and check the pressure monitoring devices (380) in the fluid line (330) to detect pressure changes during the predetermined time period. If a pressure decrease is detected, then the master valve (320) is not intact. Instead of closing the downstream barrier valve (310), any other valve in the X-mas tree production system (300) may be used to keep the test pressure for testing the master valve (320).

According to one embodiment, the method may include testing a wing valve (310). Described is a method according to any one of the embodiments described herein, or any combination of embodiments described herein, for barrier testing a wing valve (310). In FIG. 1 the wing valve is the downstream barrier valve (310). The method comprises close the wing valve (310), open the first valve (110), open the second valve (120), close the third valve (130), close the fourth valve (140), close the upstream barrier valve (320), and use the pressure increasing unit (160) to increase the fluid test pressure to the desired barrier test pressure value for the wing valve (310). Then keep the pressure for a predetermined time period and check the pressure monitoring devices (380) in the fluid line (330) to detect pressure changes during the predetermined time period. If a pressure decrease is detected, then the wing valve (310) is not intact. Instead of closing the upstream barrier valve (320), any other valve in the X-mas tree production system (300) may be used to keep the test pressure for testing the wing valve (310).

According to one embodiment, the method may include initially flushing the X-mas tree production system (300). Described is a method according to any one of the embodiments described herein, or any combination of embodiments described herein, for initially flushing the system. The method comprises to initial flush the system by, open the first valve (110), close the second valve (120), close the third valve (130), open the fourth valve (140), and vent via the X-mas tree or via an annulus of the reservoir (400). The system for barrier testing and the X-mas tree production system (300) may thus be flushed via the X-mas tree or via an annulus of the reservoir (400). In this way the X-mas tree production system (300) may be flushed from anything that would influence the barrier testing, such as for example a gas in a liquid. According to one embodiment, the system described herein, the four fluid connection lines (101, 102, 103, 104), the pressure increasing unit (160), the fluid receiving unit (170), the first valve (110), the second valve (120), the third valve (130), and the fourth valve (140), are flushed in this way to remove anything that would influence the barrier testing. This step may be taken before the method steps described above, or any combination thereof.

According to one embodiment, the method may include using fluid from the first fluid source (200). Described is a method according to any one of the embodiments described herein, or any combination of embodiments described herein, using fluid from the first fluid source (200). The method comprises that the pressure increasing unit (160) uses fluid from the first fluid source (200). The first fluid source may be a service line (200). The first fluid source (200) may be a service line to the X-mas tree, such as a service line providing mono ethylene glycol (MEG), or methanol, ethanol, scale inhibitor, or water.

At least one embodiment described herein support solving subsea production operational challenges such as reduction of well pressure for well start-up, discharge of MEG into flowline, vent of annulus, pressure release to melt hydrate plugs, to set up a bullheading pressure higher than pipeline pressure, etc. At least one embodiment described herein may eliminate umbilical annulus bleed lines, common per well or per template for production wells and water injection wells.

This written description uses examples to disclose the system, and also to enable any person skilled in the art to practice the method, including making and using the system and performing the methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system for barrier testing of a X-mas tree production system, where the X-mas tree is subsea and comprises:

a fluid line between a first barrier valve and a second barrier valve, the first barrier valve being an upstream barrier valve closer to a reservoir and the second barrier valve being a downstream barrier valve closer to an environment;

pressure monitoring devices in the fluid line and downstream of the second barrier valve, the system providing fluid at different test pressures to the fluid line between the second barrier valve and the first barrier valve;

a first fluid connection line from a fluid source to a pump, with a first valve positioned in the first fluid connection line;

a second fluid connection line from the pump to a first connection point on the fluid line between the second barrier valve and the first barrier valve, with a second valve positioned in the second fluid connection line; and a third fluid connection line from a container to a second connection point on the second fluid connection line, the second connection point being between the second valve and the first connection point, with a third valve positioned in the third fluid connection line, such that fluid at the different test pressures may be provided to the fluid line between the first barrier valve and the second barrier valve for testing of the first barrier valve and the second barrier valve.

2. The system according to claim 1, further comprising a fourth fluid connection line from a third connection point to the second connection point, the third connection point being on the first connection line and between the pump and the first valve, with a fourth valve positioned in the fourth fluid connection line.

3. The system according to claim 1, wherein the pump is configured to pump fluid in only one direction from the pump towards the second valve.

4. The system according to claim 1, further comprising a fluid connection drain line from the pump to a production flow line, with a check valve positioned in the fluid connection drain line only allowing fluid to flow from the pump to the production flow line.

5. The system according to claim 1, further comprising a filter positioned in the first fluid connection line.

6. The system according to claim 1, wherein the system is arranged on or in a manifold or on a skid.

7. The system according to claim 1, wherein the system is arranged separately from, and fluidly connected to, the X-mas tree production system.

8. The system according to claim 1, wherein the pump is a battery driven pump or a hydraulically driven pump, and the pump is retrievable.

9. The system according to claim 1, wherein the fluid source is a service line.

10. A method for barrier testing with the system according to claim 2, for testing with a test pressure above a pressure of the reservoir, the method comprising:

opening the first valve;

opening the second valve;

closing the third valve;

closing the fourth valve; and using the pump to increase the fluid test pressure in the fluid line to the desired barrier test pressure value, using fluid from the fluid source.

11. The method according to claim 10, wherein for barrier testing a master valve, the master valve being the first barrier valve, the method further comprises closing the master valve opening the first valve, opening the second valve, closing the third valve, closing the fourth valve, closing the second barrier valve, and using the pump to increase the fluid test pressure to the desired barrier test pressure value for the master valve, keep the pressure for a predetermined time period and check the pressure monitoring devices in the fluid line to detect pressure changes.

12. The method according to claim 10, wherein for barrier testing a wing valve, the wing valve being the second barrier valve, the method further comprises closing the wing valve, opening the first valve, opening the second valve, closing the third valve, closing the fourth valve, closing the upstream barrier valve, and using the pump to increase the fluid test pressure to the desired barrier test pressure value for the wing valve, keep the pressure for a predetermined time period and check the pressure monitoring devices in the fluid line to detect pressure changes.

13. The method according to claim 10, wherein the method further comprises initially flushing the system by; opening the first valve, closing the second valve, closing the third valve, opening the fourth valve, and venting via the X-mas tree or via an annulus of the reservoir.

14. The method according to claim 10, wherein the pump uses fluid from the fluid source, the fluid source being a service line.

15. A method for barrier testing with the system according to claim 2, for testing with a test pressure below a pressure of the reservoir, the method comprising:

closing the first valve opening the third valve and using the pump to reduce the fluid pressure in the fluid line to the desired barrier test pressure value.

* * * * *